US008063838B1

(12) United States Patent
Tonn

(10) Patent No.: US 8,063,838 B1
(45) Date of Patent: Nov. 22, 2011

(54) SUBMARINE MAST ANTENNA CONTROLLER

(75) Inventor: David A. Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 508 days.

(21) Appl. No.: 12/383,082

(22) Filed: Mar. 13, 2009

(51) Int. Cl.
*H01Q 1/34* (2006.01)

(52) U.S. Cl. ..... 343/709; 710/1

(58) Field of Classification Search ..... 343/703, 343/709, 713, 715, 719, 763; 710/1, 15
See application file for complete search history.

(56) References Cited

U.S. PATENT DOCUMENTS

| | | | |
|---|---|---|---|
| 4,614,274 | A | 9/1986 | LaValle et al. |
| 5,483,132 | A | 1/1996 | Arata et al. |
| 5,748,916 | A | 5/1998 | Conway et al. |
| 5,940,046 | A | 8/1999 | Saleem |
| 6,256,566 | B1 | 7/2001 | Kamiya et al. |

OTHER PUBLICATIONS

Avago Technologies. Optoisolation Products. Selection Catalog. Feb. 2, 2007.*
VXIbus Consortium, Inc. VMEbus Extensions for Instrumentation. Vxi-1. Revision 4.0. May 27, 2010.*
Lockheed Martin. Buoyant Wire Antenna System. 2006.*
Lockheed Martin. OE-538/BRC Multifunction Communication Mast Antenna System. 2006.*
Ulrich, Gary. Computer Model for a Towed Submarine Communication Antenna. Jun. 1999.*

* cited by examiner

*Primary Examiner* — Matthew Spittle
(74) *Attorney, Agent, or Firm* — James M. Kasischke; Jean-Paul A. Nasser; Michael P. Stanley

(57) ABSTRACT

The present invention is a submarine mast antenna controller for controlling a plurality of functions performed by an antenna mast of a submarine. The submarine mast antenna controller is a solid state electronic control unit on a single card that monitors various submarine mast antenna system sensors and motors, and controls electromechanical devices associated with the sensors and improves functionality over the former ACU system by consolidating control interfaces and indicators in one computer terminal via a VXI interface.

6 Claims, 6 Drawing Sheets

SUBMARINE MAST ANTENNA CONTROLLER

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None.

BACKGROUND OF THE INVENTION (1) Field of the Invention

The present invention relates to a submarine mast antenna system and more particularly, to a control device for controlling the submarine antennas, monitoring a variety of sensors and providing control signals to electromechanical devices.

(2) Description of the Prior Art

Typically, a submarine has an antenna mast proximate but outside its pressure hull. The antenna mast has several antennas mounted thereon. Numerous electromechanical components such as servomotors and relays are positioned inside the antenna mast. Currently, the antennas have antenna control units (ACUs) for electromechanical control of tuning, preamplification, and band selection settings. An electromechanical synchro-resolver, light bulb, or other indicator is positioned inside the submarine to monitor and provide feedback for the antenna and components mounted in the antenna mast. This ACU is a bulky, expensive, and heavy electromechanical device that requires manual activation of buttons and switches to operate it.

There is a need for a device and system that consolidates the indicators and manual activation buttons and switches of the ACU to a single computer terminal. Further, there is a need for a device and system that controls the various functions of the antenna mast components. Finally, there is a need for a solid-state electronic control unit that has improved functionality and is simpler to use.

SUMMARY OF THE INVENTION

Accordingly, the present invention is a submarine mast antenna controller. The submarine mast antenna controller is a solid state electronic control unit on a single card that monitors various submarine mast antenna system sensors and motors, and controls electromechanical devices associated with the sensors and improves functionality over the former ACU system by consolidating control interfaces and indicators in one computer terminal via a VXI interface. In order for the submarine mast antenna controller to function properly, electromagnetic interference between the mast and the VXI interface must be kept to a minimum by isolating the mast electrical ground from the submarine mast antenna controller chassis ground.

BRIEF DESCRIPTION OF THE DRAWINGS

These and other features and advantages of the present invention will be better understood in view of the following description of the invention taken together with the drawings wherein.

DESCRIPTION OF THE INVENTION

Figure 1:
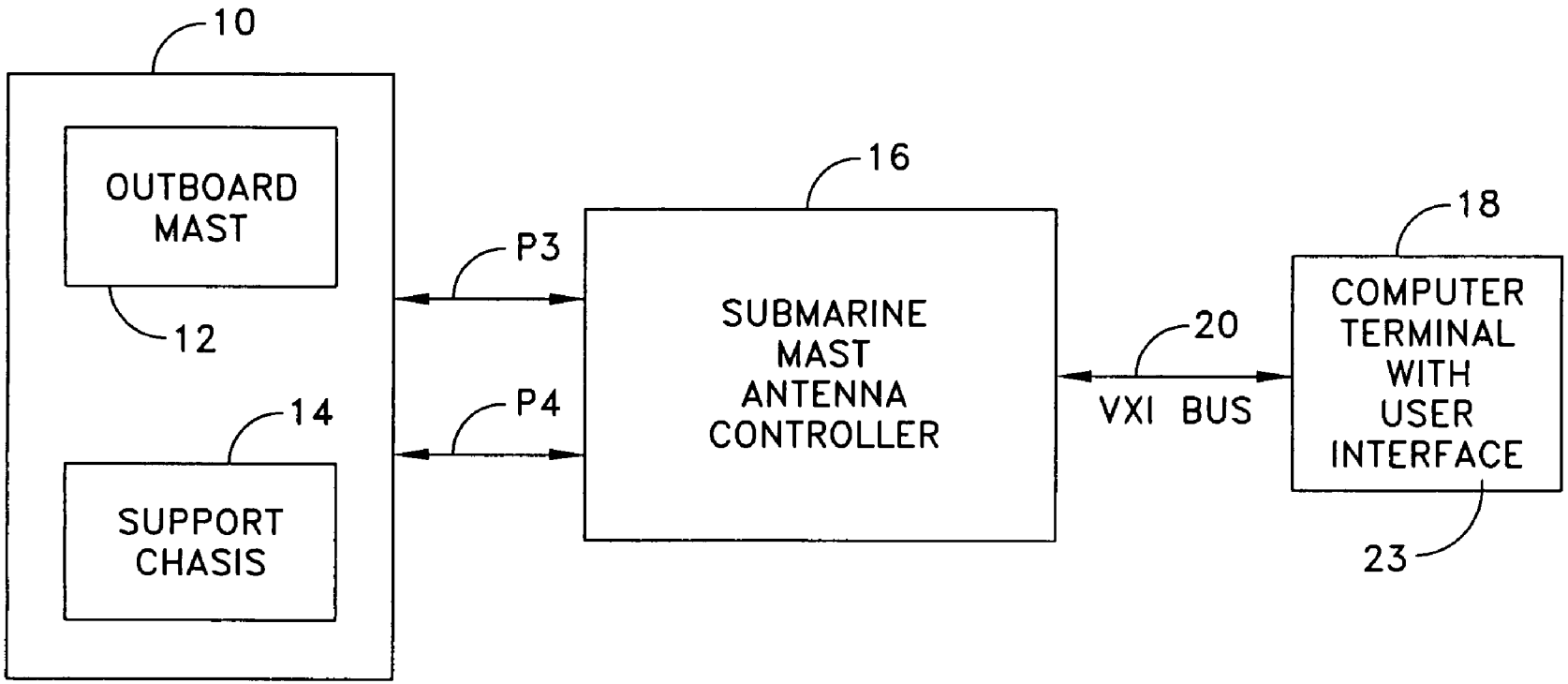
FIG. 1 is a block diagram of an antenna system interfaced with the submarine mast antenna controller and a computer terminal according to the present invention.

A block diagram of an antenna system 10 for use on a submarine (not shown) is illustrated in FIG. 1. Included in the antenna system is the outboard mast 12 containing the submarine mast antennas and the support chassis 14 containing hardware components such as the HF, UHF, GPS, etc. diplexer, RF power sensors, a motor control board, and an alternating current power source. The submarine mast antenna controller 16 of the present invention, also shown in FIG. 1, is intended to control the antennas and hardware components described above contained in the antenna system 10 and receive indicators associated with the function of the antennas and hardware components. The submarine mast antenna controller 16 is a solid state electronic control unit on a single card that is electrically connected to the antenna system via two bidirectional connections, a thirty seven pin connector P3 and a nine pin connector P4. The submarine mast antenna controller 16 is also electrically connected to a digital processing computer terminal 18 via a VME Extension for Instrumentation (VXI) bus 20. The computer terminal 18 provides a user interface 23 to issue control signals and display antenna system indicators to a user. For example in a preferred embodiment some of the antennas in the antenna system 10 can be tuned. The ability to tune the antennas is controlled by the submarine mast antenna controller 16 relying on tuning control signals issued at the user interface 23. Control signals from the submarine mast antenna controller 16 flow across the two bidirectional connections P3 and P4 while indicators flow back across the same connections. In the preferred embodiment, the connection P4 functions as an interlock connection. It is part of a safety circuit to prevent the antenna system transmitter from turning on if the antenna is not ready to broadcast.

Figure 2:
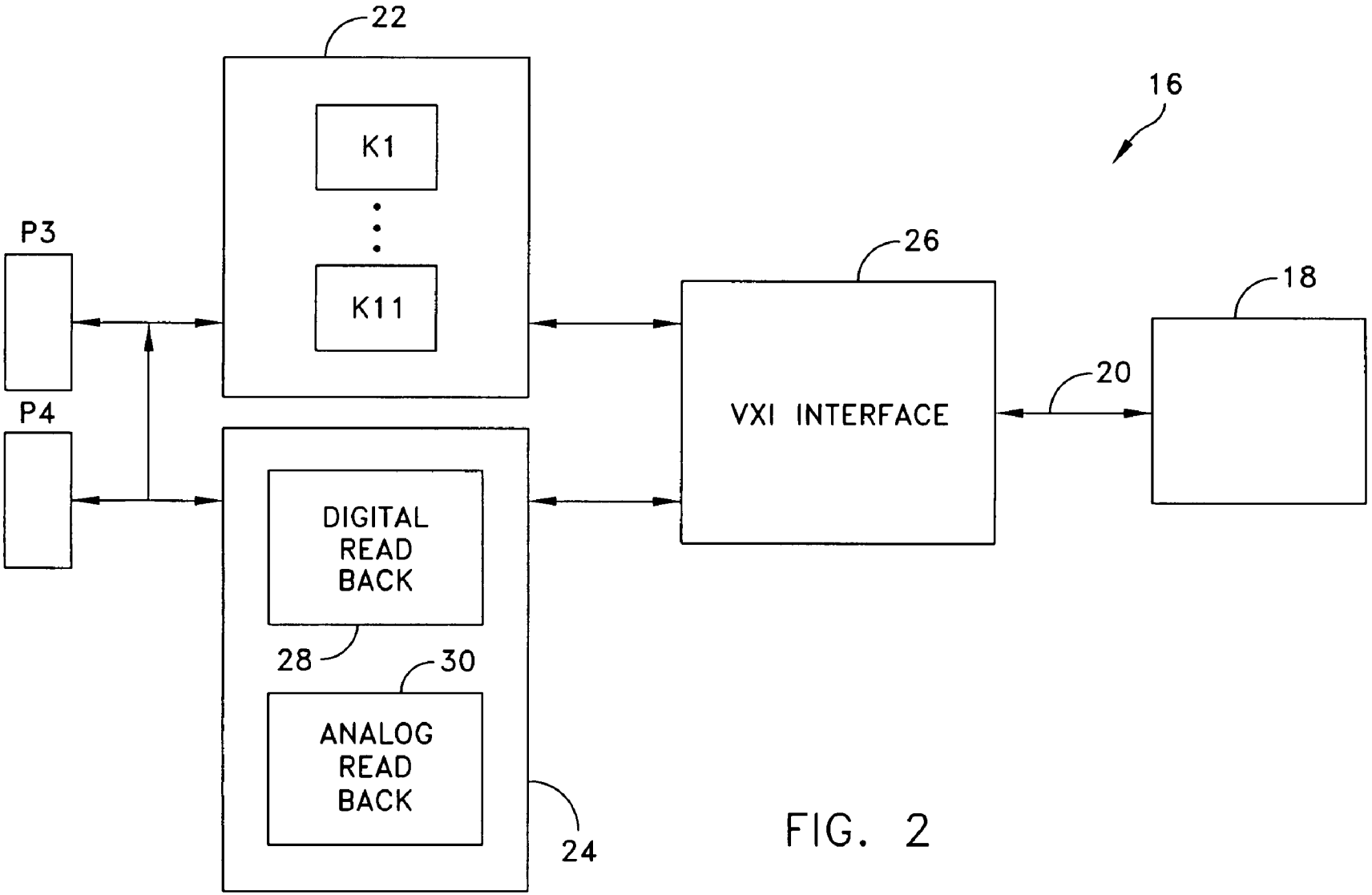
FIG. 2 is a block diagram of the submarine mast antenna controller according to the present invention.

Referring to FIG. 2, the submarine mast antenna controller 16 is divided into three functional sections including: 1) the mast function control 22; 2) the mast indicator read back 24; and 3) the VXI interface 26. The mast function control 22 section of the submarine mast antenna controller 16 receives a series of signals from the P3 and P4 connectors. These signals are routed to a group of double pole double throw non-latching relays. In a preferred embodiment there are eleven such relays K1 through K11. Each of the relays K1 through K11 is assigned a control function and the relay positions can be read back. Several relays directly control the mast antenna functions, while other relays control the tuning motors. In the preferred embodiment, at least two relays control a redirection relay in the antenna system 10.

The mast indicator read back 24 is further divided into two functional sections: the digital read back circuit 28 reads back digital indicators and analog read back circuit 30 reads back analog indicators. In the preferred embodiment there are three digital (boolean) indicator lines that are read back and six analog indicator lines that are read back originating from the antenna system 10. The digital and analog indicator signals proceed from P3 and P4. To avoid having the return line on the antenna system 10 connect to the submarine's electrical ground, in order to avoid electromagnetic interference problems, all of the indicator lines coming from the antenna system 10 (both digital and analog) are electrically isolated from submarine's electrical ground. This is accomplished by means of isolator circuits. The submarine mast antenna controller 16 uses an optical isolation network comprised of photo emitting and photo-detector integrated circuits that are described below.

Figure 3:
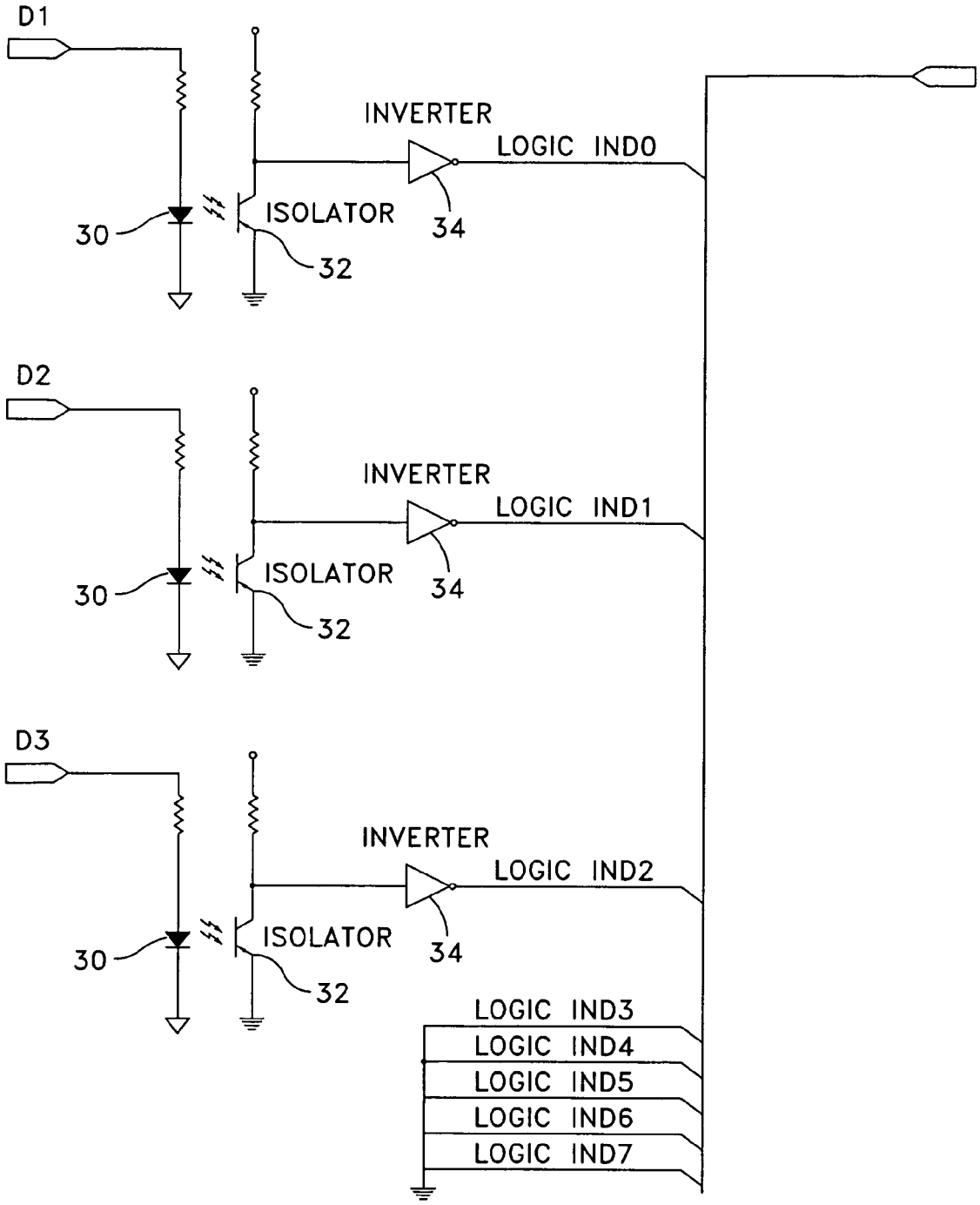
FIG. 3 is a circuit diagram of the optical isolation circuit for the digital read back according to the present invention.

Referring to FIG. 3 there is illustrated the digital read back circuit 28. Each of the three digital indicator signals D1, D2, and D3 indicating a status in the antenna system, is fed to a light emitting diode 30. Proximate to the light emitting diode 30 is a photo-detecting transistor 32 that is able to optically detect the emitted light emanating from light emitting diode 30 corresponding to a logical one if the light is emanating and zero if the light is not emanating. The photo-detecting transistor 32 indicates the digital signal while electrically isolating the antenna system 10 from the electronics of the VXI interface 26. The inverters 34 restore the logic levels to their correct state, as the isolation circuit used has the side-effect of inverting the indicator signal. The digital indicator signals D1, D2, and D3 are read back to the VXI interface.

Figure 4:
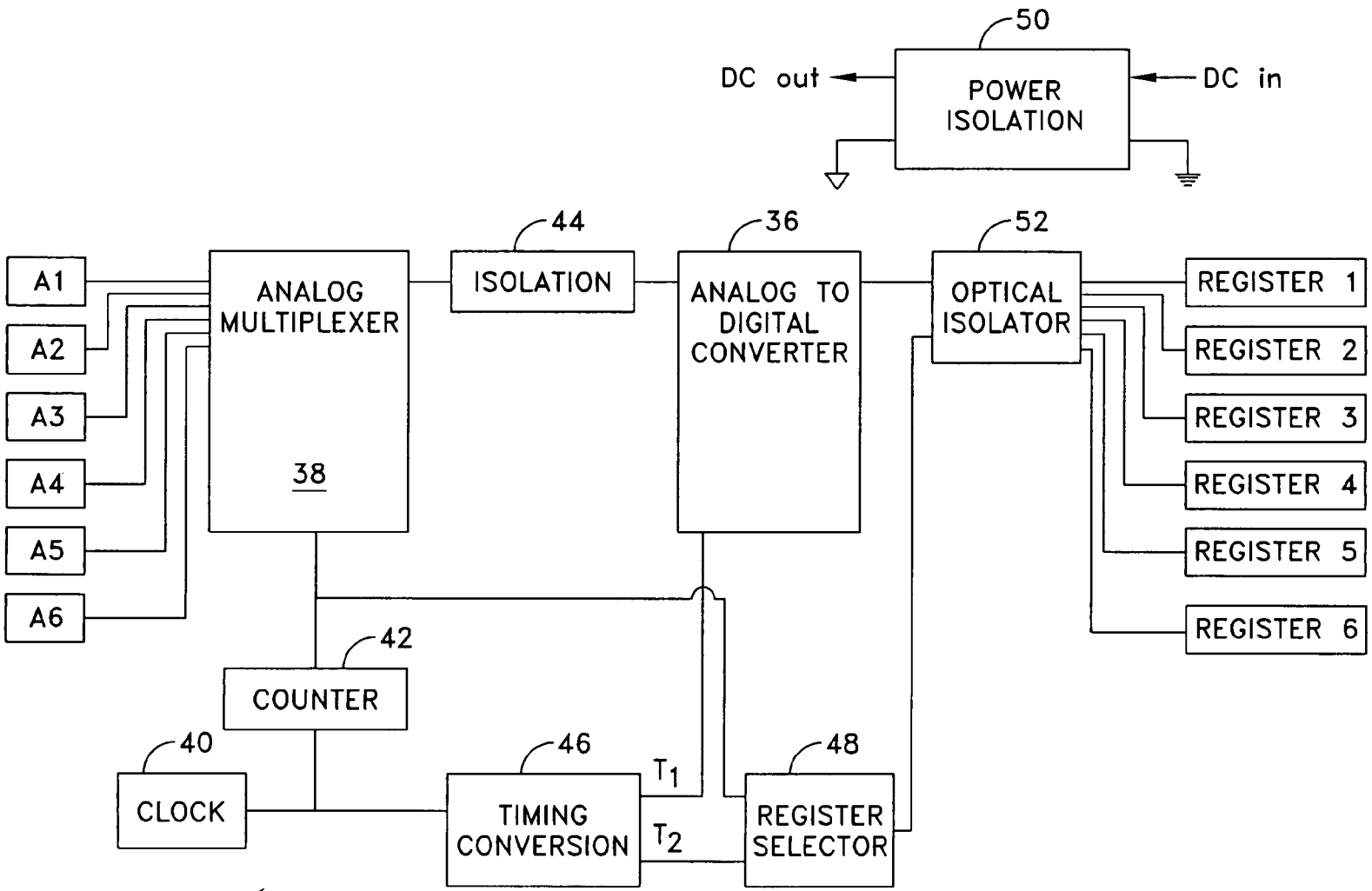
FIG. 4 is a block diagram of the analog read back portion of the submarine mast antenna controller.

The analog indicator signals are read back via a 12-bit scanning analog-to-digital (A to D) converter 36 as shown in the analog read back circuit 30 in FIG. 4. Analog indicator signals A1 through A6 are operatively connected and provided to an analog multiplexer 38. A clock 40 provides a sequential signal for synchronizing the analog read back circuit 30. A counter 42 receives the clock 40 signal and converts it into a control signal identifying each analog indicator signal A1-A6 sequentially. The analog multiplexer 38 receives the counter 42 signal, which identifies which analog indicator signal A1-A6 to provide as its output. The analog multiplexer 38 driven by counter 42 selects one of the analog indicator signals A1-A6 for conversion each clock cycle. The analog multiplexer 38 passes the signal through isolation amplifier 44 and on to the actual A to D converter 36, which is preferably an AD1674 12-bit converter. Isolation amplifier 34 precludes jitters and changes from affecting the A to D converter 35. The A to D converter 35 receives the isolated analog multiplexer 38 output and converts it into a digital signal. A timing conversion 46 is provided to add the necessary delays to the timing signal to account for analog read back circuit 30 delays. The timing conversion 46 produces time $T_1$ and $T_2$. $T_1$ is provided to the A to D converter 36, and $T_2$ is provided to a register selector 48. The register selector 48 output coordinates the selection of an input signal at the analog multiplexer 38 with an output of the A to D converter 36 so the converted signal is received in the appropriate register (1, 2, 3, 4, 5, or 6). In the preferred embodiment, the register selector 48 signal provides a command line for each register (1-6) or group of registers that receives the output.

The A to D converter 36 draws power from a power isolation circuit 50 that comprises a DC-to-DC converter (and their supporting filters). The A to D converter 36 works off the free-running 650 Hz clock 40 signal, which drives counter 42.

Figure 5:
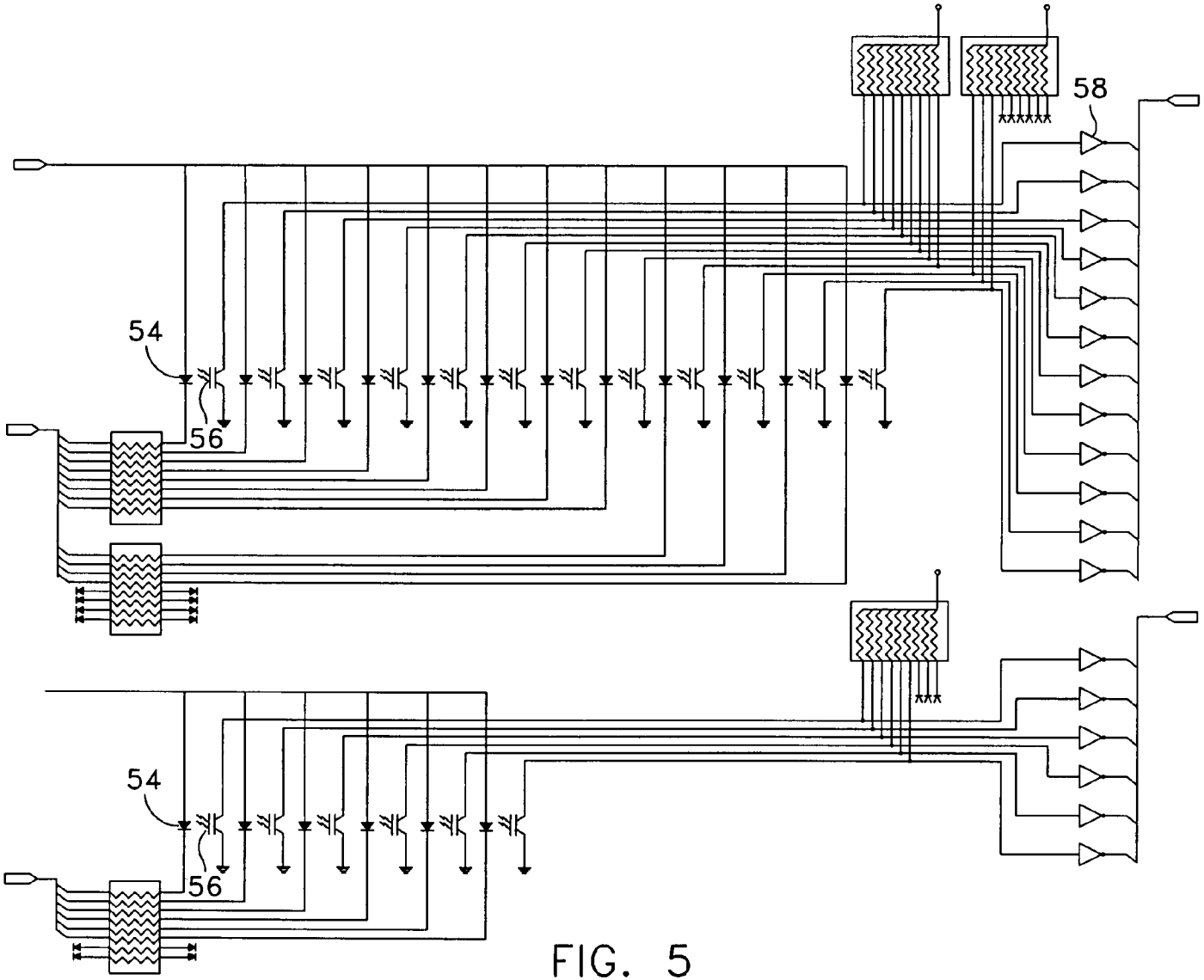
FIG. 5 is a circuit diagram of the optical isolation circuit for the analog read back according to the present invention.

Both the 12-bit digital output from the A to D converter 36 and the 6-bit digital output from register selector 48 are electrically isolated via the optical isolator 52. Referring now to FIG. 5 there is illustrated the circuit diagram for the optical isolator 52. Each of the twelve digital signals from the 12-bit digital output as well as the six digital signals from the 6-bit register select output are fed to a light emitting diode 54. Proximate to the light emitting diode 54 is a photo-detecting transistor 56 that is able to optically detect the emitted light emanating from light emitting diode 54 corresponding to a logical one if the light is emanating and zero if the light is not emanating. The photo-detecting transistor 56 indicates the digital signal while electrically isolating the electronics of the antenna system 10 with the electronics of the VXI interface 26. The inverters 58 restore the logic levels to their correct state, as the isolation circuit used has the side-effect of inverting the indicator signal.

The 12-bit digital output is then passed to the appropriate tri-state register (1-6), which is preferably a 74LS374s register. The register selector 48 controls and determines which register (1-6) the 12-bit digital output is passed to. The scanning A to D converter 36 may be used with additional registers to read up to 16 analog signals. The registers (1-6) are operatively connected to receive data from the optically isolated A to D Converter 36 12-bit digital output when the register is activated by the register selector 48 signal for that register (1-6). Multiple registers (1-6) may be joined to receive portions of the optically isolated A to D Converter 36 digital output. The registers 1-6 make the status signal from each component available to the VXI interface 26.

Figure 6:
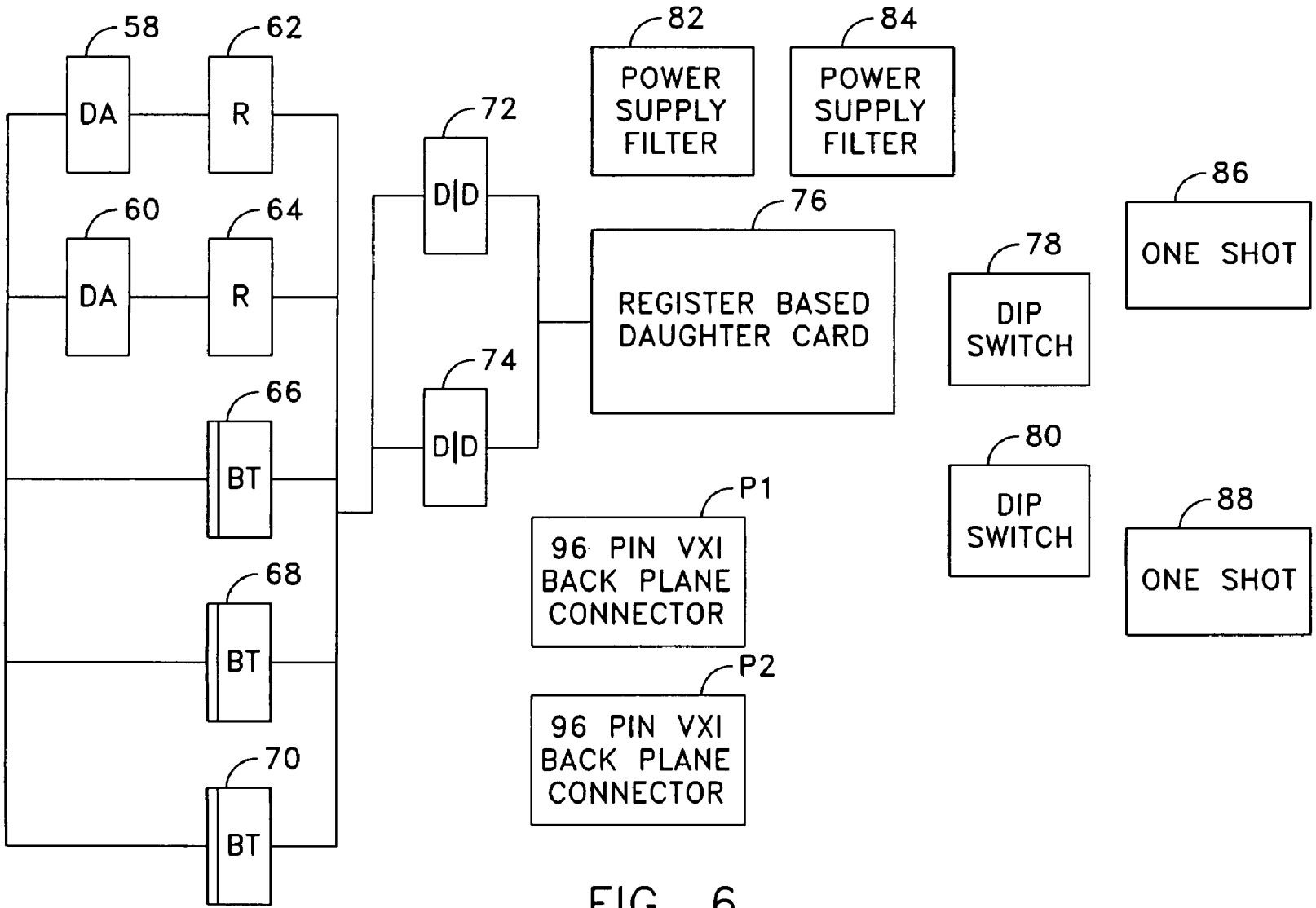
FIG. 6 is a block diagram of the VXI interface portion of the submarine mast antenna controller.

The third functional section of the submarine mast antenna controller 16, the VXI interface 26, is illustrated in FIG. 6. It has two open collector Darlington arrays 58 and 60 that drive the relays K1 through K11 in the mast function control 22 portion of the submarine mast antenna controller 16. The Darlington arrays are driven by registers 62 and 64 as well as the interlock routing provided by connector P4. The VXI interface 26 has three bus transceivers 66, 68, and 70 to handle the analog and digital read back signals as well as indicator signals from relays K1 through K11. There are two decoder/demultiplexers, 72 and 74 that handle signals to and from the registers and bus transceivers. The VXI interface 26 has two 96-pin right-angle connectors, P1 and P2, that are defined in accordance with the VXI Specification. The VXI interface includes an assembly, which is a register based daughter card 76 that implements all of the necessary interface and protocol functions in order to create a VXI register based device. Switches 78 and 80 on the VXI interface allow the user to select the logical address (which gives the base address of a register based device in the VXI memory space) and the interrupt level of the submarine mast antenna controller 16. Power supply filters 82 and 84 filter out unwanted transients in the +5V and +12V power supply lines coming from the VXI backplane connectors P1 and P2. These power signals will be used to power the logic circuitry and the relays on the submarine mast antenna controller 16. An integrated circuit and its supporting resistors and capacitors form a pair of one-shots 82 and 84 to extend the width of the READ and WRITE pulses from the register based daughter card assembly 76 in order to ensure proper operation of the registers and bus transceivers elsewhere in the submarine mast antenna controller 16.

The VXI interface 16 connects to a computer terminal 18 across a VXI bus 20 and using a VXI protocol receives as inputs the series of TTL logic control and indicator lines that contain the control and indicator signals from the Mast Function Control 22 and the Mast Read Back 24. The control and indicator signals are passed to the computer terminal 18 where a user interface 23 gives access to all of the control functions and indicators to a user.

Modifications and substitutions by one of ordinary skill in the art are considered to be within the scope of the present invention, which is not to be limited except by the following claims.

What is claimed is:

1. A submarine mast antenna control system for controlling a plurality of functions performed by an antenna system, on a submarine comprising:

a mast function control circuit that receives a plurality of indicator signals from the antenna system and assigns a control function to each signal to control an antenna system function;

a mast indicator read back circuit that is further divided into a digital read back circuit that reads back digital indicators on a plurality of indicator lines originating from the antenna system and an analog read back circuit that reads back analog indicators on a plurality of indicator lines originating from the antenna system, wherein the indicator lines coming from the antenna system are electrically isolated from the submarine's electrical ground for the purpose of preventing electromagnetic interference by means of a plurality of isolator circuits in an optical isolation network comprised of a plurality of photo emitting and photo-detector integrated circuits;

a VXI interface that handles the analog and digital read back signals as well as indicator signals from the antenna system in accordance with VXI and includes an assembly that implements all of the necessary interface and protocol functions in order to create a VXI register based device; and a computer terminal joined to the VXI interface across a VXI bus using a VXI protocol that receives as inputs from the VXI interface a plurality of TTL logic control and indicator lines that contain the control and indicator signals from the mast function control circuit and the mast read back circuit, wherein the control and indicator signals are passed to the computer terminal where a user interface gives access to all of the control functions and indicators to a user.

2. The submarine mast antenna control system according to claim 1, wherein the mast control function circuit receives said plurality of indicator signals from the antenna system through a thirty seven pin connector and a nine pin connector joined to the antenna system.

3. The submarine mast antenna control system according to claim 2, wherein the plurality of indicator signals from the antenna system are routed to a plurality of double pole double throw non-latching relays wherein each of the relays is assigned a control function and the relay positions can be read back.

4. The submarine mast antenna control system according to claim 1, wherein the mast indicator read back circuit digital read back circuit receives each of a plurality of digital indicator signals indicating a status in the antenna system, and feeds each of said plurality of digital signals to a light emitting diode and wherein proximate to the light emitting diode is a photo-detecting transistor that is able to optically detect the emitted light emanating from the light emitting diode corresponding to a logical one if the light is emanating and zero if the light is not emanating.

5. The submarine mast antenna control system according to claim 1, wherein a plurality of analog indicator signals are read back by the mast indicator read back circuit analog read back circuit via a scanning analog-to-digital converter that is operatively connected to an analog multiplexer, wherein a clock provides a sequential signal for synchronizing the analog read back circuit, a counter receives the sequential signal and converts it into a control signal identifying each analog indicator signal sequentially, wherein the analog multiplexer receives the sequential signal, which identifies which analog indicator signal to provide as its output, wherein the analog multiplexer driven by the counter selects one of the plurality of analog indicator signals for conversion each clock cycle, wherein the analog to digital converter receives the analog multiplexer output and converts it into a digital signal.

6. The submarine mast antenna control system according to claim 5, wherein output from the analog to digital converter are electrically isolated via an optical isolator, wherein each of the digital signals analog to digital converter output are fed to a light emitting diode and wherein proximate to the light emitting diode is a photo-detecting transistor that is able to optically detect the emitted light emanating from light emitting diode corresponding to a logical one if the light is emanating and zero if the light is not emanating.

* * * * *